US008445170B2

(12) United States Patent
Sakata et al.

(10) Patent No.: US 8,445,170 B2
(45) Date of Patent: May 21, 2013

(54) BINDER RESIN FOR COLOR TONERS AND COLOR TONER USING THE SAME

(75) Inventors: Kazuya Sakata, Ichihara (JP); Hiroshi Matsuoka, Ichihara (JP); Hiroyuki Takei, Kamagaya (JP); Kenji Uchiyama, Odawara (JP); Ichirou Sasaki, Chiba (JP)

(73) Assignee: Mitsui Chemicals, Inc., Minato-Ku, Tokyo (JP)

( * ) Notice: Subject to any disclaimer, the term of this patent is extended or adjusted under 35 U.S.C. 154(b) by 371 days.

(21) Appl. No.: 12/675,324

(22) PCT Filed: Aug. 27, 2008

(86) PCT No.: PCT/JP2008/002317

§ 371 (c)(1),
(2), (4) Date: Feb. 25, 2010

(87) PCT Pub. No.: WO2009/028176

PCT Pub. Date: Mar. 5, 2009

(65) Prior Publication Data

US 2010/0248121 A1 Sep. 30, 2010

(30) Foreign Application Priority Data

Aug. 30, 2007 (JP) ..... 2007-224152

(51) Int. Cl.
*G03G 9/087* (2006.01)

(52) U.S. Cl.
USPC ..... 430/109.2; 430/137.18

(58) Field of Classification Search
USPC ..... 430/109.2, 137.18
See application file for complete search history.

(56) References Cited

U.S. PATENT DOCUMENTS

| | | | | |
|---|---|---|---|---|
| 5,262,265 | A | 11/1993 | Matsunaga et al. | |
| 5,817,443 | A | 10/1998 | Matsushima et al. | |
| 5,968,701 | A | 10/1999 | Onuma et al. | |
| 6,030,739 | A * | 2/2000 | Ishikawa et al. | 430/108.3 |
| 6,329,115 | B1 | 12/2001 | Yamashita | |
| 6,497,983 | B2 * | 12/2002 | Iwa et al. | 430/109.2 |
| 2004/0068052 | A1 | 4/2004 | Uosaki et al. | |
| 2005/0048390 | A1 | 3/2005 | Moribe et al. | |
| 2005/0100808 | A1 | 5/2005 | Hashimoto et al. | |
| 2005/0106485 | A1 | 5/2005 | Yamazaki et al. | |
| 2005/0186497 | A1 | 8/2005 | Moribe et al. | |
| 2005/0186499 | A1 | 8/2005 | Okubo et al. | |
| 2007/0122731 | A1 | 5/2007 | Yoshida et al. | |
| 2009/0142683 | A1 | 6/2009 | Hashimoto et al. | |
| 2010/0209837 | A1 | 8/2010 | Matsuoka et al. | |

FOREIGN PATENT DOCUMENTS

| | | | |
|---|---|---|---|
| EP | 0 926 565 | A1 | 6/1999 |
| EP | 1011032 | A1 * | 6/2000 |
| EP | 1 197 805 | A2 | 4/2002 |
| EP | 1 505 449 | A2 | 2/2005 |
| EP | 1 566 703 | A2 | 8/2005 |
| EP | 1 672 004 | A1 | 6/2006 |
| JP | 3-118552 | A | 5/1991 |
| JP | 6-175455 | A | 6/1994 |
| JP | 10-69119 | A | 3/1998 |
| JP | 10-090943 | A | 4/1998 |
| JP | 10-133422 | A | 5/1998 |
| JP | 10-142838 | A | 5/1998 |
| JP | 10-171162 | A | 6/1998 |
| JP | 2001-188383 | A | 7/2001 |
| JP | 2002-189316 | A | 7/2002 |
| JP | 2002-365842 | A | 12/2002 |
| JP | 2003-255599 | A | 9/2003 |
| JP | 2004-53622 | A | 2/2004 |
| JP | 2004-62168 | A | 2/2004 |
| JP | 2004-144860 | A | 5/2004 |
| JP | 2004-177969 | A | 6/2004 |
| JP | 2005-134891 | A | 5/2005 |
| JP | 2005-266788 | A | 9/2005 |
| JP | 2005-266789 | A | 9/2005 |
| JP | 2006-171364 | A | 6/2006 |
| KR | 2005-0043694 | A | 5/2005 |
| WO | WO 2004/015498 | A1 | 2/2004 |
| WO | WO 2005/028545 | A1 | 3/2005 |

OTHER PUBLICATIONS

Extended Search Report from European Patent Office issued in related European Patent Application No. 08828725.5 dated Dec. 9, 2010.

International Search Report for PCT/JP2008/002317, mailed Dec. 2, 2008.

Office Action from Korean Patent Office issued in corresponding Korean Patent Application No. 10-2010-7006859 dated Oct. 26, 2011.

Extended European Search Report issued in corresponding European Application No. 08 82 8404 dated Jun. 19, 2012.

* cited by examiner

*Primary Examiner* — Jonathan Jelsma

(74) *Attorney, Agent, or Firm* — Buchanan Ingersoll & Rooney PC

(57) ABSTRACT

Provided is a binder resin for color toners which comprises at least a carboxyl group-containing vinyl resin (C), a glycidyl group-containing vinyl resin (E) and a reaction product thereof, and contains both a tetrahydrofuran (THF) soluble portion and a THF insoluble gel portion, wherein the THF soluble portion has a main peak in the molecular weight region of not less than 10,000 and less than 15,000 in the chromatogram obtained by gel permeation chromatography (GPC), the content of the THF insoluble gel portion is less than 1 mass %, and the softening point is not more than 130 degrees centigrade.

20 Claims, No Drawings

BINDER RESIN FOR COLOR TONERS AND COLOR TONER USING THE SAME

TECHNICAL FIELD

The present invention relates to a binder resin for color toners and a color toner using the same.

BACKGROUND ART

In general, electrophotography in a PPC (Plain Paper Copy) copier or printer for transferring a toner image formed on a photo-sensitive material to recording paper is carried out in the procedure described below. First, an electrostatic latent image is formed on the photo-sensitive material, the latent image is developed by using a toner, the toner image is transferred onto a sheet to be fixed such as paper or the like, and then the transferred toner image is fixed by heating with a heat roll or a film. Since the fixation is carried out under heat in a state that the heat roll or the film is directly brought into contact with the toner on the sheet to be fixed according to this method, it is performed in a short period of time and with a very high thermal efficiency, thereby achieving a very good fixing efficiency. However, though having a good thermal efficiency, the heat fixing method has a problem of a so-called offset phenomenon since the toner is brought into contact with the surface of the heat roll or the film in the melt state.

In order to obtain a resin excellent in the fixing properties and offset resistance, there has been known a resin obtained by using a high molecular weight resin and a low molecular weight resin in mixture and crosslinking a high molecular weight portion. Furthermore, to exhibit both the low temperature fixing properties and offset resistance, various techniques have been disclosed in the documents (for example, Patent Documents 1 to 3). However, these documents disclose a design suitable for a toner for monochrome use. The techniques disclosed in these documents are effective in both the low temperature fixing properties and offset resistance, but a design different from that of a toner for monochrome use is required when such a toner is applied to a color toner.

Gloss is required as an object to achieve specific to a color toner. When a toner for monochrome use is applied to a color toner, there has been still room for improvement in view of the gloss. In particular, even though a toner for monochrome use requires high elasticity in order to improve offset resistance, there has been a problem such that the unevenness on the printed surface in the color toner is caused, thereby impairing the gloss.

In Patent Document 4, there has been disclosed a binder resin without containing a gel portion, while in Patent Document 5, there has been disclosed a color toner having the content of a gel component of less than 5 weight %. However, in these documents, since the range of Mw/Mn is narrow, offset resistance is not sufficient. Therefore, there is room for improvement in balancing the gloss and offset resistance.

Patent Document 1: Japanese Patent Laid-open No. 2002-189316

Patent Document 2: Japanese Patent Laid-open No. 2004-144860

Patent Document 3: Japanese Patent Laid-open No. H10-90943

Patent Document 4: Japanese Patent Laid-open No. 2004-177969

Patent Document 5: Japanese Patent Laid-open No. H10-171162

DISCLOSURE OF THE INVENTION

Accordingly, the present invention is to solve a problem of the gloss specific to a color toner. Specifically, the present invention is to provide a binder resin for color toners and a color toner excellent in balancing the gloss and various properties required for a toner. The binder resin for color toners of the present invention can be suitably used for a color toner for electrophotography used for development of an electrostatic image in electrophotography, electrostatic recording, electrostatic printing or the like.

The present invention provides a binder resin for color toners, wherein the binder resin contains at least a carboxyl group-containing vinyl resin (C), a glycidyl group-containing vinyl resin (E) and a reaction product thereof, and contains both a tetrahydrofuran (THF) soluble portion and a THF insoluble gel portion, the aforementioned THF soluble portion has a main peak in the molecular weight region of not less than 10,000 and less than 15,000 in the chromatogram obtained by gel permeation chromatography (GPC), the content of the aforementioned THF insoluble gel portion is less than 1 mass %, and the softening point is not more than 130 degrees centigrade.

The weight-average molecular weight (Mw)/the number-average molecular weight (Mn) of the aforementioned binder resin for color toners may be not more than 8.

The weight-average molecular weight (Mw)/the number-average molecular weight (Mn) of the aforementioned binder resin for color toners may be not less than 9 and not more than 41.

It is preferable that the aforementioned binder resin for color toners does not substantially have a peak in the molecular weight region of not less than 400,000 in the GPC chromatogram.

Meanwhile, the present invention provides a binder resin for color toners, wherein the binder resin contains at least a carboxyl group-containing vinyl resin (C), a glycidyl group-containing vinyl resin (E) and a reaction product thereof, and contains both a tetrahydrofuran (THF) soluble portion and a THF insoluble gel portion, the aforementioned THF soluble portion has a main peak in the molecular weight region of not less than 10,000 and less than 15,000 in the chromatogram obtained by gel permeation chromatography (GPC), the content of the aforementioned THF insoluble gel portion is less than 1 mass %, the softening point is not more than 130 degrees centigrade, the weight-average molecular weight (Mw)/the number-average molecular weight (Mn) is not less than 9 and not more than 41, and the binder resin does not substantially have a peak in the molecular weight region of not less than 400,000 in the GPC chromatogram.

In the aforementioned binder resin for color toners, the content of a volatile component remained in the binder resin may be not more than 200 ppm.

In the aforementioned binder resin for color toners, the storage modulus G' at 160 degrees centigrade may be not less than 50 and less than 10,000 Pa measured at a frequency of 6.28 rad/sec.

The aforementioned binder resin for color toners satisfies the following conditions: the carboxyl group-containing vinyl resin (C) contains a high molecular weight vinyl resin (H) in which the THF soluble portion has a peak in the molecular weight region of not less than 150,000 and less than 600,000 in the GPC chromatogram and a low molecular weight vinyl resin (L) in which the THF soluble portion has a peak in the molecular weight region of not less than 10,000 and less than 15,000 in the GPC chromatogram; the mass ratio (H/L) of the high molecular weight vinyl resin (H) to the low molecular weight vinyl resin (L) in the carboxyl group-containing vinyl resin (C) is from 5/95 to 40/60; the acid value of the carboxyl group-containing vinyl resin (C) is not less than 1 mgKOH/g and not more than 35 mgKOH/g; and the THF soluble portion of the glycidyl group-containing vinyl resin (E) has a peak in the molecular weight region of not less than 20,000 and not more than 80,000 in the GPC chromatogram and the epoxy value of the glycidyl group-containing vinyl resin (E) is from 0.003 to 0.1 Eq/100 g.

The aforementioned binder resin for color toners may have a second peak in the molecular weight region of not less than 200,000 and less than 300,000 in the GPC chromatogram.

In the aforementioned binder resin for color toners, a component of a molecular weight of not less than 400,000 may be not more than 18 mass %.

Furthermore, according to the present invention, a method for producing the aforementioned binder resin for color toners is provided. The method includes a step of melt-kneading at least one of the carboxyl group-containing vinyl resins (C) and at least one of the glycidyl group-containing vinyl resins (E) at a temperature range of not lower than 140 degrees centigrade and not higher than 220 degrees centigrade, and reacting a carboxyl group with a glycidyl group.

Besides, according to the present invention, a color toner is provided. The color toner contains at least the aforementioned binder resin for color toners, a coloring agent and a charge controlling agent.

The aforementioned color toner may be obtained by a grinding method.

In the aforementioned color toner, the storage modulus G' at 160 degrees centigrade may be not less than 50 Pa and less than 10,000 Pa measured at a frequency of 6.28 rad/sec.

According to the present invention, there are provided a binder resin for color toners and a color toner excellent in balancing the gloss and various properties required for a toner.

BEST MODE FOR CARRYING OUT THE INVENTION

The present invention will be described in more detail below.

In the present invention, the term "polymerization" may include the meaning of copolymerization, and the term "polymer" may include the meaning of a copolymer.

The binder resin for color toners of the present invention contains at least a carboxyl group-containing vinyl resin (C), a glycidyl group-containing vinyl resin (E) and a reaction product thereof. It is possible to obtain a toner excellent in balancing the fixing properties and offset resistance by containing such a resin. Furthermore, the binder resin for color toners of the present invention contains both the tetrahydrofuran (THF) soluble portion and the THF insoluble portion. It is possible to obtain a binder resin excellent in balancing the gloss and various properties by containing both the soluble and insoluble portions.

The binder resin for color toners of the present invention contains the tetrahydrofuran (THF) soluble portion in the binder resin which exhibits a main peak in the molecular weight region of not less than 10,000 and less than 15,000 in the molecular weight distribution measured by gel permeation chromatography (GPC) and preferably in the molecular weight region of not less than 12,500 and less than 14,500.

By having a main peak in this region, the binder resin becomes excellent in balancing various properties such as the fixing properties, durability, storage stability and the like. The molecular weight of the main peak of not less than the above lower limit is preferable from the viewpoint of improvement of storage stability and durability of the toner, while the molecular weight of not more than the above upper limit is preferable from the viewpoint of improvement of the fixing properties.

Meanwhile, it is preferable that the binder resin for color toners of the present invention does not substantially have a peak in the molecular weight region of not less than 400,000 in the GPC chromatogram. Furthermore, the binder resin for color toners of the present invention may have at least one peak shoulder in the molecular weight region of not less than 200,000 and less than 300,000. There is obtained an effect excellent in offset resistance by having a peak shoulder in this region.

Furthermore, in the binder resin for color toners of the present invention, a component having a molecular weight of not less than 400,000 is preferably not more than 18% and more preferably not more than 10%. According to the above configuration, it is possible to obtain a binder resin for color toners excellent in the fixing properties as well as the gloss.

Meanwhile, the binder resin for color toners of the present invention contains the THF insoluble portion derived from a crosslinking component generated by the reaction of the carboxyl group-containing vinyl resin (C) with the glycidyl group-containing vinyl resin (E). The content of the THF insoluble portion in the binder resin for color toners of the present invention is less than 1 mass % in the binder resin. Herein, in case of a color toner, it requires the gloss, and needs a design that is different from that of a toner for monochrome use. When the gel portion is excessively high, offset resistance becomes excellent because of high elasticity. However, when the gel portion is used for a color toner, even though a smooth surface is temporarily formed by using a heat roll or the like during fixation of the toner, there is a problem such that the printed surface becomes uneven due to the restoring force on the surface attributable to the resin elasticity. As a result, the gloss is reduced. In particular, a conventional binder resin for monochrome use contains lots of high molecular component and gel portion so that there has been a problem such that the modulus becomes high and the gloss is thus damaged. Accordingly, the conventional binder resin for monochrome use has not been suitable for use in a color toner. In the present invention, the THF insoluble portion is contained in an amount of less than 1 mass %, whereby a binder resin for color toners excellent in the gloss is obtained.

Furthermore, the content of the THF insoluble portion in the binder resin of the present invention is preferably not less than 0.1 and less than 0.8 mass % and more preferably not less than 0.4 and less than 0.6 mass % from the viewpoint of a balance between the gloss and offset resistance. When the content of the THF insoluble portion is within the above range, excellent gloss can be achieved while maintaining offset resistance. Furthermore, the toner is easily ground so that the toner productivity is also enhanced.

The binder resin for color toners of the present invention has a softening point of not more than 130 degrees centigrade and preferably not less than 90 degrees centigrade and not more than 130 degrees centigrade. In case of a color toner, control of the softening point is also important in addition to control of the content of the THF insoluble portion. The softening point represents the deformability of the resin due to heat under a load, and is an index of the deformability of the toner due to the pressure and heat while passing a fixing section. Therefore, as the softening point is lower, the printed surface is smoothed while passing the fixing section and the gloss of the toner is easily improved. When the softening point is within the aforementioned range, a binder resin suited for use in color toners excellent in balancing the gloss and various properties is obtained.

Moreover, in the binder resin for color toners of the present invention, the content of a volatile component remained in the binder resin is preferably not more than 200 ppm and more preferably not more than 100 ppm. Further, the lower limit of the content of the residual volatile component is not particularly limited, but it is, for example, not less than 10 ppm. The content of the residual volatile component within the aforementioned range is preferable because attachment of the toner inside the toner production facility is suppressed and the toner productivity is thus improved. Besides, one of preferable reasons is that odor during toner printing is also suppressed.

Besides, The binder resin for color toners of the present invention has a storage modulus G' at 160 degrees centigrade of preferably not less than 50 and less than 10,000 Pa, more preferably not less than 100 and less than 5,000 Pa and further preferably not less than 100 and less than 1,500 Pa measured at a frequency of 6.28 rad/sec. In the present invention, since the content of the THF insoluble portion is low, a binder resin for color toners with low elasticity is obtained. In order to achieve the gloss, it is important to have a resin with low elasticity. So, when the storage modulus G' at 160 degrees centigrade is within the above range, the gloss for the color toner becomes excellent.

Besides, the weight-average molecular weight (Mw)/the number-average molecular weight (Mn) of the binder resin for color toners of the present invention is preferably not less than 8. The Mw/Mn is more preferably not less than 8 and not more than 45, further preferably not less than 9 and not more than 41 and further preferably not less than 9 and not more than 30. When the Mw/Mn value is within the above range, it is possible to enhance offset resistance of the resulting binder resin for color toners.

Hereinafter, the carboxyl group-containing vinyl resin (C) and the glycidyl group-containing vinyl resin (E) contained in the binder resin for color toners of the present invention will be described in detail.

<Carboxyl Group-Containing Vinyl Resin (C)>

The carboxyl group-containing vinyl resin (C) is obtained by using a known polymerization method employing at least one of carboxyl group-containing monomers, at least one of styrene based monomers and at least one of acrylic based monomers (including methacrylic based monomers, hereinafter the same).

Examples of the carboxyl group-containing monomer in the present invention include acrylic acid, methacrylic acid, maleic anhydride, maleic acid, fumaric acid, cinnamic acid, mono esters of an unsaturated dibasic acid such as methyl fumarate, ethyl fumarate, propyl fumarate, butyl fumarate, octyl fumarate, methyl maleate, ethyl maleate, propyl maleate, butyl maleate, octyl maleate and the like. Preferably used are acrylic acid, methacrylic acid, fumaric acid, methyl fumarate, ethyl fumarate, propyl fumarate, butyl fumarate and octyl fumarate. Particularly preferably used are acrylic acid and methacrylic acid.

Examples of the styrene based monomer to be used in the present invention include styrene, p-methylstyrene, m-methylstyrene, o-methylstyrene, p-methoxystyrene, p-phenylstyrene, p-chlorostyrene, 3,4-dichlorostyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene and the like. Particularly preferably used is styrene.

Examples of the acrylic based monomer to be used in the present invention include acrylic esters such as methyl acrylate, ethyl acrylate, propyl acrylate, butyl acrylate, octyl acrylate, cyclohexyl acrylate, stearyl acrylate, benzyl acrylate, furfuryl acrylate, hydroxyethyl acrylate, hydroxybutyl acrylate, dimethylaminomethyl acrylate, dimethylaminoethyl acrylate and the like; methacrylic esters such as methyl methacrylate, ethyl methacrylate, propyl methacrylate, butyl methacrylate, octyl methacrylate, cyclohexyl methacrylate, stearyl methacrylate, benzyl methacrylate, furfuryl methacrylate, hydroxyethyl methacrylate, hydroxybutyl methacrylate, dimethylaminomethyl methacrylate, dimethylaminoethyl methacrylate and the like; and amides such as acrylamide, methacrylamide, acrylonitrile, methacrylonitrile, N-substituted acrylamide, N-substituted methacrylamide and the like. Among these, preferably used are acrylic esters, methacrylic esters, acrylonitrile and methacrylonitrile. Particularly preferably used are butyl acrylate, methyl methacrylate, butyl methacrylate and hydroxyethyl acrylate.

In the present invention, in addition to the aforementioned monomers, there may also be used diesters of an unsaturated dibasic acid such as dimethyl fumarate, dibutyl fumarate, dioctyl fumarate, dimethyl maleate, dibutyl maleate, dioctyl maleate and the like as monomers.

A crosslinking monomer having two or more double bonds may be used, as necessary, for the carboxyl group-containing vinyl resin (C) of the present invention as a monomer. Examples of the crosslinking monomer include aromatic divinyl compounds such as divinyl benzene, divinyl naphthalene and the like; diacrylate compounds and methacrylate compounds thereof such as ethylene glycol diacrylate, 1,3-butylene glycol diacrylate, 1,4-butanediol diacrylate, 1,5-pentanediol diacrylate, 1,6-hexanediol diacrylate, neopentylglycol diacrylate, diethylene glycol diacrylate, triethylene glycol diacrylate, tetraethylene glycol diacrylate, polyoxyethylene(2)-2,2-bis(4-hydroxyphenyl)propane diacrylate, polyoxyethylene (4)-2,2-bis(4-hydroxyphenyl)propane diacrylate and the like; and polyfunctional crosslinking monomers and methacrylate compounds thereof such as pentaerythritol triacrylate, trimethylolethane triacrylate, trimethylolpropane triacrylate, tetramethylolmethane tetraacrylate and the like. When these crosslinking monomers are used, the content of the crosslinking monomer is preferably less than 0.5 mass % based on 100 mass % of other monomers contained in the carboxyl group-containing vinyl resin (C). When the content of the crosslinking monomer is excessively high, a crosslinked body is easily produced by the reaction of a carboxyl group with a glycidyl group to be described below. In order to suppress production of such a crosslinked body, to suppress increasing the elasticity at a high temperature and to suppress deterioration of the gloss, the content of the crosslinking monomer is preferably within the above range.

<Glycidyl Group-Containing Vinyl Resin (E)>

Besides, the glycidyl group-containing vinyl resin (E) may be obtained by a known polymerization method employing at least one of glycidyl group-containing monomers and at least one of other monomers. As the monomer constituting the glycidyl group-containing vinyl resin (E), there can be exemplified the aforementioned monomers in addition to the glycidyl group-containing monomers.

The THF soluble portion of the glycidyl group-containing vinyl resin (E) has a peak preferably in the molecular weight region of not less than 20,000 and not more than 80,000, more preferably in the molecular weight region of not less than 30,000 and not more than 70,000 and further preferably in the molecular weight region of not less than 40,000 and not more than 60,000 in the GPC chromatogram. Furthermore, the epoxy value of the glycidyl group-containing vinyl resin (E) is from 0.003 to 0.1 Eq/100 g, more preferably from 0.007 to 0.045 Eq/100 g and further preferably from 0.010 to 0.032

Eq/100 g. The low molecular weight component and the high molecular weight component containing a crosslinking component are in the optimum phase-separated state, whereby the binder resin can achieve a balance among durability, storage stability, productivity, fixing properties, offset resistance performance and the like, in addition to excellent gloss required for a color toner. In view of this, the peak molecular weight and the epoxy value of the glycidyl group-containing vinyl resin (E) become one of important control factors. When the peak molecular weight is not less than the above lower limit, the durability becomes excellent and the feature of maintaining development is enhanced when it is used for a toner. Furthermore, the crosslinking formation is sufficiently obtained so that offset resistance performance becomes excellent. Meanwhile, when the peak molecular weight is excessively low or the epoxy value is excessively high, offset resistance might possibly be reduced. It is considered that, in the reaction of a carboxyl group with a glycidyl group to be described below, the molecular weight among the crosslinked points becomes small and the non-crosslinking low molecular weight component is excessively phase-separated as the reaction proceeds. As a result, it is considered that an effect of offset resistance of the crosslinking component is reduced. On the other hand, when the peak molecular weight is not more than the above upper limit or the epoxy value is not less than the above upper limit, it is possible to suppress deterioration of the fixing properties or deterioration of the toner productivity. When the peak molecular weight is excessively high, the high molecular weight component might possibly hinder the fixing properties of the low molecular weight component onto paper. Furthermore, when the peak molecular weight is excessively high, much time and energy have been required for a grinding process so that the productivity might possibly be lowered. In the present invention, the epoxy value refers to moles of the epoxy groups present in 100 g of the resin, and it may be measured in accordance with JIS K-7236.

Examples of the glycidyl group-containing monomer in the present invention include glycidyl acrylate, β-methyl glycidyl acrylate, glycidyl methacrylate, β-methyl glycidyl methacrylate and the like, and preferably used are glycidyl methacrylate and β-methyl glycidyl methacrylate.

The glycidyl group-containing vinyl resin (E) may not necessarily be a single glycidyl-containing vinyl resin, and two or more glycidyl group-containing vinyl resins may be used. In that case, the glycidyl group-containing vinyl resin (E) may preferably satisfy the above properties as a whole. Further, to produce a single polymer, the glycidyl group-containing monomer is added in the middle of polymerization or added separately at the beginning and end of polymerization, whereby it is also possible to keep the width of the distribution of the glycidyl group in the molecules.

It is preferable that the carboxyl group-containing vinyl resin (C) of the present invention contains a high molecular weight vinyl resin (H) and a low molecular weight vinyl resin (L).

The ratio (H/L) of the high molecular weight vinyl resin (H) to the low molecular weight vinyl resin (L) in the carboxyl group-containing vinyl resin (C) is preferably from 5/95 to 40/60 and more preferably from 10/90 to 30/70 from the viewpoint of a general balance among the toner productivity, fixing properties, offset resistance, durability and the like, in addition to the gloss for the color toner. When the ratio of the high molecular weight vinyl resin (H) is high, offset resistance and durability are improved when it is used for a toner. On the other hand, the ratio of the high molecular weight vinyl resin (H) is preferably not more than a predetermined value from the viewpoint of improvement of the gloss. Accordingly, when H/L is within the above range, it is possible to produce a color toner excellent in balancing the above performances.

In the carboxyl group-containing vinyl resin (C), the acid value is preferably not less than 1 mgKOH/g and not more than 35 mgKOH/g and more preferably not less than 5 mgKOH/g and not more than 13 mgKOH/g. When the acid value is not less than the above lower limit, the reaction with the glycidyl group-containing vinyl resin (E) easily proceeds and, offset resistance becomes excellent when it is used for a toner. Further, the amount of the unreacted high molecular weight vinyl resin (H) can be reduced and the fixing properties of the low molecular weight vinyl resin (L) are enhanced. When the acid value is not more than the upper limit, it is possible to suppress excessive reaction with the glycidyl group-containing vinyl resin and it is possible to prevent the crosslinking component from being excessively phase-separated from the non-crosslinking component. As a result, deterioration of offset resistance can be controlled.

<High Molecular Weight Vinyl Resin (H)>

In the present invention, the high molecular weight vinyl resin (H) contained in the carboxyl group-containing vinyl resin (C) contains the THF soluble portion having a peak preferably in the molecular weight region of not less than 150,000 and less than 600,000 and more preferably in the molecular weight region of not less than 170,000 and less than 450,000 in the GPC chromatogram. When the THF soluble portion is within the above region, a balance among excellent gloss and various properties such as durability, fixing properties, offset resistance and the like required for a toner can be achieved. When the peak molecular weight is not less than the above lower limit, resin strength is sufficiently obtained and durability becomes excellent when it is used for a toner. Furthermore, in the formation of a crosslinked body by the reaction with the glycidyl group to be described below, formation of the crosslinked body is sufficiently achieved and excellent offset resistance is exhibited. Besides, when the peak molecular weight is not more than the above upper limit, excellent gloss is achieved. Also, when it is adjusted to the proper range of the viscoelasticity of the toner, unreacted high molecular weight vinyl resin remained in large quantities can be prevented, and deterioration of the fixing properties caused by unreacted high molecular weight vinyl resin can be prevented.

In the high molecular weight vinyl resin (H), the acid value (AVH) is preferably from 3.0 to 32.5 mgKOH/g, more preferably from 6.0 to 23.0 mgKOH/g and further preferably from 9.0 to 19.0 mgKOH/g. The acid value is preferably within the above range from the viewpoint of a balance among the gloss and various properties such as the fixing properties, offset resistance and the like of the toner. When the acid value is not less than the above lower limit, the reaction with the glycidyl group-containing vinyl resin to be described below takes place easily and offset resistance of the toner becomes excellent. On the other hand, when the acid value is not more than the above upper limit, it is possible to prevent the reaction with the glycidyl group-containing vinyl resin from excessively taking place to excessively increase its viscosity, and it is possible to prevent the loss modulus in the fixing temperature region of the toner from becoming excessively high. As a result, it is possible to suppress deterioration of the fixing performance. Incidentally, in the present invention, the acid value refers to mg of potassium hydroxide necessary to neutralize 1 g of the resin.

The high molecular weight vinyl resin (H) may not necessarily be a single polymer, and two or more high molecular weight vinyl resins may also be used. In that case, the high molecular weight vinyl resin (H) may preferably satisfy the above properties as a whole. Further, to produce a single polymer, the carboxyl group-containing monomer is added in the middle of polymerization or added separately at the beginning and end of polymerization, whereby it is also possible to keep the width of the distribution of the carboxyl group in the molecules.

<Low Molecular Weight Vinyl Resin (L)>

In the present invention, the low molecular weight vinyl resin (L) contained in the carboxyl group-containing vinyl resin (C) contains the THF soluble portion having a peak preferably in the molecular weight region of not less than 10,000 and less than 15,000 and more preferably in the molecular weight region of not less than 12,000 and less than 14,500 in the GPC chromatogram. When the THF soluble portion is within the above region, excellent fixing properties are achieved. When the peak molecular weight is not less than the above lower limit, storage stability and durability of the toner can be maintained excellent. When the peak molecular weight is not more than the above upper limit, the fixing performance can be maintained excellent.

In the low molecular weight vinyl resin (L), the acid value (AVL) is preferably from 1.3 to 50.0 mgKOH/g and further preferably from 3.0 to 10.0 mgKOH/g. When the acid value is within the above region, excellent fixing performance and offset resistance performance are exhibited. When the acid value (AVL) is not less than the above lower limit, the compatibility with the high molecular weight vinyl resin (H) is excellent so that deterioration of the durability can be prevented and occurrence of fine offset can be prevented. When the acid value is not more than the above upper limit, the reactivity with the glycidyl group-containing vinyl resin (E) can be prevented from being excessively increased and the reaction of the glycidyl group-containing vinyl resin (E) with the high molecular weight vinyl resin (H) can be substantially prevented from being hindered. Furthermore, offset resistance and the fixing properties can be maintained excellent.

The low molecular weight vinyl resin (L) may not necessarily be a single polymer, and two or more low molecular weight vinyl resins may be used. In that case, the low molecular weight vinyl resin (L) may preferably satisfy the above properties as a whole. Further, to produce a single polymer, the carboxyl group-containing monomer is added in the middle of polymerization or added separately at the beginning and end of polymerization, whereby it is also possible to keep the width of the distribution of the carboxyl group in the molecules.

In the present invention, as a method for producing the carboxyl group-containing vinyl resin (C) and the glycidyl group-containing vinyl resin (E), there may be adopted any of known polymerization methods such as solution polymerization, bulk polymerization, suspension polymerization, emulsion polymerization and the like, or the combination thereof. Solution polymerization, bulk polymerization and the combination thereof are suitably adopted from the viewpoints of adjustment of the molecular weight distribution, mixing properties of the high molecular weight vinyl resin (H) and the low molecular weight vinyl resin (L), and convenience of distribution adjustment of the carboxyl group and the glycidyl group.

The carboxyl group-containing vinyl resin (C) may be obtained by polymerizing each of the high molecular weight vinyl resin (H) and the low molecular weight vinyl resin (L) alone in advance, and then mixing these resins in the melt state or the solution state. Further, it may be obtained by polymerizing any one of the high molecular weight vinyl resin (H) or the low molecular weight vinyl resin (L) alone, and then polymerizing the other vinyl resin in the presence of the former vinyl resin.

Examples of the solvent used for solution polymerization include aromatic hydrocarbon solvents such as benzene, toluene, ethylbenzene, xylene, cumene and the like. These solvents may be used alone or a mixture thereof may be used, and preferably used is xylene.

Polymerization may be carried out by using a polymerization initiator or so-called thermal polymerization may be carried out without using a polymerization initiator. As a polymerization initiator, any polymerization initiators may be usually used as far as they can be used as radical polymerization initiators. Examples thereof include azo type initiators such as 2,2'-azobisisobutyronitrile, 2,2'-azobis(4-methoxy-2,4-dimethylvaleronitrile), dimethyl-2,2'-azobisisobutyrate, 1,1'-azobis(1-cyclohexanecarbonitrile), 2-(carbamoylazo)-isobutyronitrile, 2,2'-azobis(2,4,4-trimethylpentane), 2-phenylazo-2,4-dimethyl-4-methoxyvaleronitrile, 2,2'-azobis(2-methyl-propane) and the like; ketone peroxides such as methylethylketone peroxide, acetylacetone peroxide, cyclohexanone peroxide and the like; peroxy ketals such as 1,1-bis(t-butylperoxy)-3,3,5-trimethylcyclohexane, 1,1-bis(butylperoxy)cyclohexane, 2,2-bis(t-butylperoxy)butane and the like; hydroperoxides such as t-butyl hydroperoxide, cumene hydroperoxide, 1,1,3,3-tetramethylbutyl hydroperoxide and the like; dialkyl peroxides such as di-t-butyl peroxide, t-butylcumyl peroxide, di-cumyl peroxide, 2,5-dimethyl-2,5-di(t-butylperoxy)hexane, α,α'-bis(t-butylperoxyisopropyl)benzene and the like; diacyl peroxides such as isobutyryl peroxide, octanoyl peroxide, decanoyl peroxide, lauroyl peroxide, 3,5,5-trimethylhexanoyl peroxide, benzoyl peroxide, m-toluoyl peroxide and the like; peroxydicarbonates such as diisopropyl peroxydicarbonate, di-2-ethylhexyl peroxydicarbonate, di-n-propyl peroxydicarbonate, di-2-ethoxyethyl peroxycarbonate, di-methoxyisopropyl peroxydicarbonate, di(3-methyl-3-methoxybutyl)peroxycarbonate and the like; sulfonyl peroxides such as acetylcyclohexyl sulfonyl peroxide and the like; and peroxyesters such as t-butyl peroxyacetate, t-butyl peroxyisobutyrate, t-butyl peroxyneodecanoate, cumyl peroxyneodecanoate, t-butyl peroxy-2-ethylhexanoate, t-butyl peroxy laurate, t-butyl peroxy benzoate, t-butyl peroxy isopropyl carbonate, di-t-butyldiperoxy isophthalate and the like. These initiators may be used singly or in combination of two or more kinds. The type and amount of the polymerization initiator may be properly selected depending on the reaction temperature, concentration of the monomer and the like. The polymerization initiator is usually used in an amount of 0.01 to 10 mass % per 100 mass % of the monomer in use.

The binder resin of the present invention contains, as described above, at least the carboxyl group-containing vinyl resin (C) and the glycidyl group-containing vinyl resin (E). The ratio (C/E) of the carboxyl group-containing vinyl resin (C) to the glycidyl group-containing vinyl resin (E) is preferably from 87/13 to 99/1 and more preferably from 90/10 to 97/3 in terms of the mass ratio from the viewpoint of offset resistance. When the ratio of the glycidyl group-containing vinyl resin (E) is excessively high, the viscosity is increased and sufficient fixing properties are not achieved in some cases. It is considered that, in the reaction of the carboxyl group with the glycidyl group to be described below, the molecular weight among the crosslinked points becomes small and the crosslinking component is excessively shrunk as the reaction proceeds. Therefore, the low molecular weight component cannot get into a mesh, and the crosslinking component is excessively phase-separated from the non-crosslinking component. As a result, it is considered that an effect of offset resistance of the crosslinking component is reduced. Besides, when the ratio of the glycidyl group-containing vinyl resin (E) is excessively low, the crosslinking component is not sufficiently generated due to the reaction of the carboxyl group-containing vinyl resin with the glycidyl group-containing vinyl resin and offset resistance might possibly be reduced.

As a method for reacting the carboxyl group-containing vinyl resin (C) with the glycidyl group-containing vinyl resin (E), preferably used is a method involving mixing at least one of the carboxyl group-containing vinyl resins (C) and at least one of the glycidyl group-containing vinyl resins (E) in the melt state for the reaction. As such a method, any conventionally known methods may be used. For example, a method involving introducing both resins into a reaction container equipped with a stirrer or the like and heating the resulting material for the reaction in the melt state, or a method involving reacting both resins in the presence of a solvent and removing the solvent, may be adopted. In particular, preferably used is a method employing a twin screw kneader. Concrete examples thereof include a method involving mixing powders of the carboxyl group-containing vinyl resin (C) and the glycidyl group-containing vinyl resin (E) by the use of a Henschel mixer or the like, and then conducting melt-kneading and reaction using a twin screw kneader, and a method involving feeding the carboxyl group-containing vinyl resin (C) and the glycidyl group-containing vinyl resin (E) in the melt state to a twin screw kneader for conducting melt-kneading and reaction. The temperature for conducting melt-kneading and reaction is different depending on the type of the carboxyl group-containing vinyl resin (C) and the glycidyl group-containing vinyl resin (E), but it is in the range of 140 to 220 degrees centigrade and preferably in the range of 150 to 220 degrees centigrade. When the reaction temperature is excessively low, the reaction speed might possibly be lowered and a crosslinked body might not be possibly sufficiently formed. In order to obtain sufficient offset resistance, it is better to cause sufficient formation of the crosslinked body. Besides, when the reaction temperature is excessively high, depolymerization occurs so that the volatile content remained in the binder resin might possibly be increased. The reaction temperature is preferably not more than a predetermined value from the viewpoints of the feature of maintenance of excellent development of the toner, suppression of problems of odor and the like.

For the purpose of improved dispersion of a releasing agent in the toner, the releasing agent to be described below may be mixed in the carboxyl group-containing vinyl resin (C) and the glycidyl group-containing vinyl resin (E) to conduct melt-kneading and reaction. Further, the releasing agent may be added in any step of producing the carboxyl group-containing vinyl resin (C) and/or the glycidyl group-containing vinyl resin (E) so that the carboxyl group-containing vinyl resin (C) and/or the glycidyl group-containing vinyl resin (E) containing a releasing agent may be produced. Thereafter, when melt-kneading and reaction as described above may be carried out, excellent dispersion state of the releasing agent can also be achieved. The amount of the releasing agent added at this time is preferably not more than 10 mass parts based on 100 mass parts of the binder resin.

The thus-obtained resin is cooled and ground to give a binder resin for a toner. As a method for cooling and grinding, any of conventionally known methods can be adopted, and as a method for cooling, a steel belt cooler or the like may also be used for rapid cooling.

In the binder resin of the present invention, it is considered that the amount of the THF insoluble portion, the reaction degree of the carboxyl group-containing vinyl resin (C) and the glycidyl group-containing vinyl resin (E), the peak molecular weight of the THF soluble portion and the like are adjusted in the optimum range, whereby it is considered that a proper phase separation structure is formed between the low molecular weight component and the high molecular weight component containing a crosslinking component in the binder resin, and excellent fixing performance and offset resistance performance are thus exhibited. Furthermore, the gloss required for a color toner is improved, and a balance among various properties such as the fixing performance, offset resistance performance and the like required for a toner, and the gloss required for a color toner has been excellent. The binder resin for monochrome use of the related art is excellent in offset resistance because of its high elasticity, but the binder resin has not been suitable for use in a color toner. That is, there has been a problem such that excellent gloss performance could not be exhibited. In the present invention, an excellent balance among excellent gloss and various properties required for a color toner has been achieved.

The color toner of the present invention contains at least the binder resin for color toners of the present invention, a coloring agent and a charge controlling agent.

The color toner of the present invention is produced according to a conventionally known method. The color toner of the present invention is preferably obtained by a grinding method. For example, at least the binder resin for color toners of the present invention, a coloring agent and a charge controlling agent are added, and as necessary other additives such as a releasing agent or the like are added, which are sufficiently mixed using a powder mixer. Thereafter, the resulting mixture is melt-kneaded using a kneading machine such as a heat roll, a kneader or an extruder for sufficiently mixing individual constituent components. The melt-kneaded material is cooled, and then ground and classified to collect particles having a particle diameter of ordinarily 4 to 15 micrometers. The collected particles are coated with a surface treatment agent according to the powder mixing method, to obtain a toner. Or, as necessary, the toner may be subjected to spheroidizing treatment using a surface treatment device or the like. As a surface treatment method, there can be mentioned, for example, a method of spheroidizing the toner by inflowing it in a hot air jet, a method of chamfering the toner by mechanical impact and the like.

The color toner of the present invention has a glass transition temperature (Tg) obtained according to JIS K-7121 standard is preferably from 45 to 75 degrees centigrade and more preferably from 50 to 65 degrees centigrade. When Tg is excessively low, the storage stability is not sufficient in some cases. When Tg is excessively high, the fixing properties are not sufficient in some cases.

Meanwhile, in the color toner of the present invention, the storage modulus G' at 160 degrees centigrade is preferably not less than 50 Pa and not more than 10,000 Pa and more preferably not less than 100 Pa and not more than 5,000 Pa measured at a frequency of 6.28 rad/s. When the storage modulus G' is within the above range, a color toner excellent in balancing the gloss and various properties is obtained.

<Releasing Agent>

Any conventionally known releasing agents may be used as the releasing agent of the present invention. Examples thereof include aliphatic hydrocarbon based wax such as low molecular weight polyethylene, low molecular weight polypropylene, polyolefin copolymer, polyolefin wax, paraffin wax, microcrystalline wax, Fisher-Tropsch wax and the like;

oxides of aliphatic hydrocarbon based wax such as oxidized polyethylene wax; vegetable based wax such as candelilla wax, carnauba wax, Japan wax, rice wax and jojoba wax; animal based wax such as bee wax, lanoline and whale wax; mineral based wax such as ozokerite, ceresine and petrolatum; wax principally constituted of aliphatic esters such as montanic acid ester wax and castor wax; and partially or totally deacidified aliphatic esters such as deacidified carnauba wax. Further, examples include saturated linear aliphatic acids such as palmitic acid, stearic acid and montanic acid or long-chain alkyl carboxylic acids having a long-chain alkyl group; unsaturated aliphatic acids such as brassidic acid, eleostearic acid and parinaric acid; saturated alcohols such as stearyl alcohol, eicosyl alcohol, behenyl alcohol, carnaubyl alcohol, ceryl alcohol and melissyl alcohol, or long-chain alkyl alcohol having a long-chain alkyl group; polyhydric alcohols such as sorbitol; aliphatic acid amides such as linoleic amide, oleic amide and lauric amide; saturated aliphatic acid bis amides such as methylene bis stearamide, ethylene bis capramide, ethylene bis lauramide and hexamethylene bis stearamide; unsaturated aliphatic acid amides such as ethylene bis oleamide, hexamethylene bis oleamide, N,N'-dioleyl adipamide and N,N'-dioleyl sebacamide; aromatic based bisamides such as m-xylene bis stearamide and N,N'-distearyl isophthalamide; aliphatic metal salts such as calcium stearate, calcium laurate, zinc stearate and magnesium stearate; wax formed by grafting vinyl based monomers such as a styrene based monomer, an acrylic based monomer, a carboxyl group-containing monomer and a glycidyl group-containing monomer to aliphatic hydrocarbon wax; partially esterified compounds of fatty acids and polyhydric alcohols such as behenic acid monoglyceride; and methyl ester compounds having a hydroxyl group obtained by hydrogenating vegetable oils and fats. Further, examples include an n-paraffin mixture obtained from higher aliphatic hydrocarbon or petroleum fraction having one or more double bonds obtained by an ethylene polymerization method or an olefination method by pyrolysis of petroleum based hydrocarbons; wax having a functional group such as a hydroxyl group, an ester group, a carboxyl group or the like obtained by subjecting polyethylene wax obtained by an ethylene polymerization method, higher aliphatic hydrocarbon obtained by a Fisher-Tropsch synthesis or the like to liquid-phase oxidation with a molecular oxygen-containing gas in the presence of boric acid and boric anhydride; wax synthesized by a metallocene catalyst such as polyethylene, polypropylene, polybutene, polypentene, polyhexene, polyheptane, polyoctene, ethylene-propylene copolymer, ethylene-butene copolymer and butene-propylene copolymer; and ester group-containing wax obtained by the reaction of a halide of long-chain alkylcarboxylic acid with polyhydric alcohol or condensation with long-chain alkyl carboxylic acid with polyhydric alcohol. These releasing agents may be used singly or in combination of two or more kinds. In the present invention, the amount of the releasing agent added is preferably from 0.2 to 12 mass parts, more preferably from 1 to 10 mass parts and further preferably from 2 to 8 mass parts based on 100 mass parts of the binder resin. These releasing agents may be added in the middle of producing the toner, may be added into the polymer component as described above, or may be added during the reaction of the carboxyl group with the glycidyl group. These addition methods may be further used in combination.

<Charge Controlling Agent>

It is preferable that the color toner of the present invention contains a charge controlling agent in order to keep a positive electrostatic-charging property or a negative electrostatic-charging property. As a charge controlling agent, conventionally known charge controlling agents may be used. Examples of the positive charge controlling agent include nigrosins and modified products of nigrosin with aliphatic metal salts and the like; quaternary ammonium salts such as tributylbenzylammonium-1-hydroxy-4-naphtosulfonate salt and tetrabutylammonium tetrafluoro borate, and onium salts such as their phosphonium salts that are analogs of those compounds and the lake pigments thereof; triphenylmethane dyes and lake pigments thereof (laking agents: phosphorus tungstic acid, phosphorus molybdenic acid, phosphorus tungsten molybdenic acid, tannic acid, lauric acid, gallic acid, ferricyanide, ferrocyanide and the like); metal salts of higher fatty acids; diorganotin oxides such as dibutyltin oxide, dioctyltin oxide and dicyclohexyltin oxide; diorganotin borates such as dibutyltin borate, dioctyltin borate and dicyclohexyltin borate; guanidine compounds, imidazole compounds, and imidazolium salts. Further, the examples include quaternary ammonium salt group-containing copolymers obtained by a means of quaternization or the like with para-toluenesulfonic acid alkyl ester after copolymerizing dialkylaminoalkyl (meth) acrylate and a styrene based monomer and as necessary an acrylic based monomer. As the negative charge controlling agent, an organic metal complex and a chelate compound are effective, and examples thereof include a mono-azo metal complex, an acetylacetone metal complex, an aromatic hydroxycarboxylic acid metal complex, an aromatic dicarboxylic acid metal complex; aromatic hydroxycarboxylic acid, aromatic monocarboxylic acid or aromatic polycarboxylic acid and metal salts thereof, anhydride thereof, esters thereof, and bisphenol derivative such as bisphenol. Further, the examples include azo type metal compounds having a coordination center metal selected from the group consisting of Sc, Ti, V, Cr, Co, Ni, Mn and Fe, and cation selected from hydrogen ion, sodium ion, potassium ion and ammonium ion; metal compounds of aromatic hydroxycarboxylic acid derivative and aromatic polycarboxylic acid derivatives having a coordination center metal selected from the group consisting of Cr, Co, Ni, Mn, Fe, Ti, Zr, Zn, Si, B and Al, and cation selected from the group consisting of hydrogen ion, sodium ion, potassium ion, ammonium ion and aliphatic ammonium; (aromatic hydroxycarboxylic acid derivative and aromatic polycarboxylic acid may have an alkyl group, an aryl group, a cycloalkyl group, an alkenyl group, an alkoxy group, an aryloxy group, a hydroxyl group, an alkoxycarbonyl group, an aryloxycarbonyl group, an acyl group, an acyloxy group, a carboxyl group, halogen, a nitro group, a cyano group, an amide group, an amino group or a carbamoyl group as a substituent); and a polymer having a sulfonic acid group-containing monomer such as a copolymer of a sulfonic acid group-containing acrylamide based monomer, a styrene based monomer and an acrylic based monomer as a constituent component. Particularly preferred are salicylic acid based metal compounds containing Ca, Al, Zr, Zn or Cr. These charge controlling agents may be used singly or in combination of two or more kinds. The amount of the charge controlling agent added is preferably from 0.05 to 10 mass %, more preferably from 0.1 to 5 mass % and further preferably from 0.2 to 3 mass % based on 100 mass % of the binder resin, from the viewpoint of a balance between the charge amount and fluidity of the toner. Further, as a method of adding the charge controlling agent, a method of adding it into the inside of the toner, a method of externally adding, or a combination thereof may be applied.

<Coloring Agent>

The color toner of the present invention contains a coloring agent. As a coloring agent, conventionally known pigments and dyes may be used. Examples of the pigment include mineral fast yellow, navel yellow, Naphthol Yellow S, Hanza Yellow G, Permanent Yellow NCG, Tartrazine Lake, molybdenum orange, Permanent Orange GTR, Pyrazolone Orange, Benzidine Orange G, Permanent Red 4R, Watchung Red calcium salt, eosine lake, Brilliant Carmine 3B, manganese violet, Fast Violet B, Methyl Violet Lake, cobalt blue, Alkali Blue Lake, Victoria Blue Lake, Phthalocyanine Blue, Fast Sky Blue, Indanthrene Blue BC, chrome green, Pigment Green B, Malachite Green Lake, Final Yellow Green G and the like. Examples of the magenta coloring pigment include C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 49, 50, 51, 52, 53, 54, 55, 57, 58, 60, 63, 64, 68, 81, 83, 87, 88, 89, 90, 112, 114, 122, 123, 163, 202, 206, 207, 209, 238; C.I. Pigment Violet 19; C.I. Violet 1, 2, 10, 13, 15, 23, 29, 35 and the like. Examples of the cyan coloring pigment include C.I. Pigment Blue 2, 3, 15, 15:1, 15:2, 15:3, 16, 17; C.I. Acid Blue 6; C.I. Acid Blue 45; copper phthalocyanine pigments whose phthalocyanine skeleton has been substituted with 1 to 5 phthallmide methyl group and the like. Examples of the yellow coloring pigment include C.I. Pigment Yellow 1, 2, 3, 4, 5, 6, 7, 10, 11, 12, 13, 14, 15, 16, 17, 23, 65, 73, 74, 83, 93, 97, 155, 180, 185; C.I. Vat Yellow 1, 3, 20 and the like. Examples of the black pigment include carbon black such as furnace black, channel black, acetylene black, thermal black, lamp black and the like. Examples of the dye include C.I. Direct Red 1; C.I. Direct Red 4; C.I. Acid Red 1; C.I. Basic Red 1; C.I. Mordant Red 30; C.I. Direct Blue 1; C.I. Direct Blue 2; C.I. Acid Blue 9; C.I. Acid Blue 15; C.I. Basic Blue 3; C.I. Basic Blue 5; C.I. Mordant Blue 7; C.I. Direct Green 6; C.I. Basic Green 4; C.I. Basic Green 6; Solvent Yellow 162 and the like. These coloring agents may be used singly or in combination of two or more kinds. The amount of the coloring agent added to the toner is preferably from 0.05 to 20 mass %, more preferably from 0.1 to 15 mass % and further preferably from 0.2 to 10 mass % based on 100 mass % of the binder resin.

Meanwhile, the color toner of the present invention may be used as necessary by partially adding, for example, polyvinyl chloride, polyvinyl acetate, polyester, polyvinyl butyral, polyurethane, polyamide, rosin, polymerized rosin, modified rosin, terpene resin, phenolic resin, aromatic petroleum resin, vinyl chloride resin, styrene-butadiene resin, styrene-ethylene-butadiene-styrene block copolymer, styrene-(meth) acrylic copolymer, chromane-indene resin, melamine resin or the like, in the ranges in which the effect of the present invention is not impaired.

<Surface Treatment Agent>

In the color toner of the present invention, a surface treatment agent is preferably present between the toner and a carrier, or between toners by adding a surface treatment agent to the surface of the toner. By adding the surface treatment agent, the powder fluidity, storage stability, electrification stability and environmental stability can be improved, and life of a developing agent can also be improved. As a surface treatment agent, conventionally known surface treatment agents may be used, and examples thereof include fine silica powder, fine titanium oxide powder and hydrophobically modified product thereof. As fine silica powder, there may be used wet silica, dry silica, a complex of dry silica and metal oxide and the like. Fine silica powder subjected to hydrophobic treatment with an organic silicon compound or the like may be further used. As the hydrophobic treatment, for example, a method of treating fine silica powder generated by vapor-phase oxidation of a silicon halogenated compound with a silane compound and then treated with an organic silicon compound can be cited. Examples of the silane compound to be used for the hydrophobic treatment include hexamethyl disilazane, trimethyl silane, trimethyl chlorosilane, trimethyl ethoxysilane, dimethyl dichlorosilane, methyl trichlorosilane, allyldimethyl chlorosilane, allylphenyl dichlorosilane, benzyldimethyl chlorosilane, bromomethyl dimethylchlorosilane, α-chloroethyl trichlorosilane, β-chloroethyl trichlorosilane, chloromethyl dimethylchlorosilane, triorganosilyl mercaptan, trimethylsilyl mercaptan, triorganosilyl acrylate, vinyldimethyl acetoxysilane, dimethyldiethoxy silane, dimethyldimethoxy silane, diphenyldiethoxy silane, hexamethyl disiloxane, 1,3-divinyl tetramethyl disiloxane, 1,3-diphenyl tetramethyl disiloxane and the like. Examples of the organic silicon compound to be used for the hydrophobizing treatment include silicone oils such as dimethyl silicone oil, methylphenyl silicone oil, α-methyl styrene-modified silicone oil, chlorophenyl silicone oil, fluorine-modified silicone oil and the like. Further, fine titanium oxide powder subjected to oil treatment and fine particle of a vinyl resin of 0.03 to 1 micro-meter may also be used. As the surface treatment agent in addition thereto, there may also be used a lubricant such as polyethylene fluoride, zinc stearate and polyvinylidene fluoride; an abrasive such as cerium oxide, silicon carbide, strontium titanate, magnetic powder, alumina and the like; and an electroconductivity imparting agent such as carbon black, zinc oxide, antimony oxide, tin oxide and the like. However, in order to obtain the color toner having a well-balanced performance such as the gloss and the like, the surface treatment agent may not be contained. As the shape of the surface treatment agent, there may also be used various shapes such as a particle having a small particle diameter of not more than 100 nano-meters, a particle having a large particle diameter of not less than 100 nano-meters, octahedron shape, hexahedron shape, needle shape, fiber shape and the like. The surface treatment agents may be used singly or in combination of two or more kinds. The amount of the surface treatment agent added is preferably from 0.1 to 10 mass parts and more preferably from 0.1 to 5 mass parts based on 100 mass parts of the toner.

<Carrier>

When the color toner of the present invention is used as a two-component developing agent, conventionally known carriers may be used as a carrier. For example, there may be used particles having an average particle diameter of 20 to 300 micro-meters composed of metals such as surface-oxidated or non-oxidated iron, cobalt, manganese, chromium and rare earths, and alloys thereof or oxides thereof. As the carrier, there may be used carriers with its surface coated by a styrene based resin, an acrylic based resin, a silicone based resin, a polyester resin, a fluorine based resin or the like.

The resulting color toner according to the present invention may be applied to various known development methods. Examples thereof include, though not restricted thereto, a cascade development method, a magnetic brush method, a powder cloud method, a touch-down development method, a so-called micro-toning method using, as a carrier, a magnetic toner produced by grinding method, and a so-called bipolar magnetic toner method in which a required amount of toner charges are obtained by the frictional electrification between magnetic toners. The resulting color toner according to the present invention may also be applied to various cleaning methods such as a conventionally known fur brush method, a blade method and the like. Further, the resulting color toner according to the present invention may be applied to various conventionally known fixing methods. Concrete examples thereof include an oil-free heat roll method, an oil-coated heat roll method, a thermal belt fixing method, a flash method, an oven method, a pressure fixing method and the like. It may also be applied to a fixing apparatus using an electromagnetic induction heating method. Further, it may also be applied to an image forming method involving an intermediate transfer step.

EXAMPLES

The present invention is now illustrated in detail below with reference to Examples. However, the present invention is not restricted to these Examples. Also, "parts" hereinafter indicates weight parts unless otherwise mentioned specifically. Furthermore, methods of measuring and judging data are as follows.

<Acid Value>

The acid value in the present invention was calculated in the following manner. An accurately weighed sample was dissolved in a mixed solvent of xylene and n-butanol (mass ratio=1:1). The solution was titrated with alcohol of standardized N/10 potassium hydroxide (7 g of special class potassium hydroxide was added to 5 g of ion exchange water, diluted to 1 L (litter) with first class ethyl alcohol, and then titrated with N/10 hydrochloric acid and 1% phenolphthalein solution to determine titer=F) for calculating the acid value from its neutralization amount according to the following equation.

$$\text{Acid value(mgKOH/g)}=(N/10\text{KOH titration amount (ml)}\times F\times 5.61)/(\text{sample g}\times 0.01)$$

<Peak Molecular Weight>

The peak molecular weight in the present invention obtained by the GPC (gel permeation chromatography) method is a molecular weight calculated with reference to a calibration curve produced by the use of the monodispersed standard polystyrene. The measurement conditions are as follows.

GPC apparatus: SHODEX GPC SYSTEM-21 (Showa Denko K.K.)

Detector: SHODEX RI SE-31 (Showa Denko K.K.)

Column: 3 of SHODEX GPC KF-807L and 1 of GPC KF-800D (Showa Denko K.K.) are serially connected for use Solvent: tetrahydrofuran (THF)

Flow rate: 1.2 ml/min.

Sample concentration: 0.002 g-resin/ml-THF

Injected amount: 100 μL

The component insoluble in THF was removed from the sample solution by means of a filter right before the measurement. Further, to measure the molecular weight of a toner, 10 mass % of the toner was fully dissolved in 90 mass % of THF, and then 50 mass parts of SIMGON talc and 50 mass parts of titanium (CR-95) were added thereto for carrying out centrifugation. The resulting supernatant liquid was adjusted to a predetermined concentration for measuring.

<THF Insoluble Portion>

The THF insoluble portion of the binder resin in the present invention was obtained in the following manner. 0.4 g of a resin and 39.5 g of THF were fed into a 50-mL lidded glass sample tube. This sample tube was stirred under conditions of a rotation speed of 50 rpm and a temperature of 22 degrees centigrade for 48 hours, and then allowed to stand at 22 degrees centigrade for 24 hours. Thereafter, 5 g of the supernatant liquid in the sample tube was dried at 150 degrees centigrade for 1 hour and then its weight was measured, and this weight was taken as Xg to calculate the THF insoluble content (mass %) according to the following equation.

Incidentally, when the binder resin contains a wax and a wax component insoluble in THF is present in the wax, the wax insoluble in THF is not included in the THF insoluble portion. In this specification, the THF insoluble portion refers to a gel portion which is insoluble in THF.

$$THF\ \text{Insoluble Portion (mass \%)} = \frac{(0.4/(0.4+39.5)) - X/5}{0.4/(0.4+39.5)} \times 100$$

Furthermore, the THF insoluble portion of the color toner in the present invention was obtained in the following manner. 1.0 g of a toner was weighed, put into an extraction thimble, placed in a Soxhlet extractor, extracted with 200 ml of THF for 12 hours and then the extracted soluble content was evaporated. Thereafter, the resulting soluble portion was vacuum-dried at 100 degrees centigrade for 6 hours. Then, the amount of the THF soluble portion was measured and its weight was taken as Xg. The amount of the component other than the resin in the toner was taken as Yg and the THF insoluble content (mass %) was calculated according to the following equation.

$$THF\ \text{Insoluble Portion (mass \%)} = \frac{1.0-(X+Y)}{1.0-Y} \times 100$$

<Softening Point (Tm)>

Tm in the present invention was measured by using an elevated flow tester CFT-500 manufactured by Shimadzu Corporation. A sample having a volume of 1 $cm^3$ was melted and flowed under conditions of a diameter of a die pore of 1 mm, a pressure of 20 $kg/cm^2$ and a temperature increase speed of 6 degrees centigrade/min and Tm was determined as the temperatures when the sample is half-size between started and finished flowing.

<Epoxy Value>

The epoxy value was measured in the following procedure. 0.2 g to 5 g of a resin sample was weighed accurately and put into a 200-mL Erlenmeyer flask, and then 25 mL of dioxane was added thereto and dissolved therein. 25 mL of a 1/5 normal hydrochloric acid solution (dioxane solvent) was added, and the resulting solution was sealed and fully mixed, and then allowed to stand for 30 minutes. Next, 50 mL of a mixed solution of toluene and ethanol (1:1 volume ratio) was added, and then the reaction solution was titrated with a 1/10 normal aqueous sodium hydroxide solution using cresol red as an indicator. Based on the titration results, the epoxy value (Eq/100 g) was calculated according to the following equation.

$$\text{Epoxy value}(Eq/100\text{ g})=[(B-S)\times N\times F]/(10\times W)$$

Herein, W refers to the amount of collected sample (g), B refers to the amount of the aqueous sodium hydroxide solution (ml) required for a blank test, S refers to the amount of the aqueous sodium hydroxide solution (ml) required for the test of the sample, N refers to the normality of the aqueous sodium hydroxide solution, and F refers to the titer of the aqueous sodium hydroxide solution.

<Quantitative Method of Residual Volatile Component (Internal Standard Method)>

0.01 g of 1,2-dichlorobenzene was weighed accurately and diluted in 70 ml of acetone for mixing them well to produce an internal standard solution. At this time, the concentration of 1,2-dichlorobenzene in the internal standard solution was defined as z. 1 g of a resin to measure, 1 g of the internal standard solution and 20 g of acetone were respectively weighed accurately and mixed to dissolve the resin (resin:

$x_0$ gram, internal standard solution: $y_0$ gram). After the dissolution, the solution was allowed to stand to separate the precipitate and the supernatant liquid. 3 micro-liters of the supernatant liquid was analyzed using gas chromatography under the following conditions.

Device: GL Sciences Inc.
GC-353 column: 50 m×0.25 mm
ULBON HR-1
Column temperature: 60 degrees centigrade
Injection temperature: 180 degrees centigrade
$N_2$ gas flow rate: 10 ml/min.
Sample solution: 5% acetone solution
Amount of solution injected: 3 micro-liters
Detector: FID A volatile component contained in the resin was specified from the obtained gas chromatogram. Subsequently, the volatile components were weighed. Herein, styrene was explained as an example and the same procedure was applied to other components.

Firstly, a calibration curve of the specified component was prepared.

The calibration curve was prepared in the following manner.

1. 0.2 g of 1,2-dichlorobenzene and 0.1 g of styrene are weighed accurately in a 20-mL screw tube and diluted with 10 g of acetone, and then mixed well.
2. 0.2 g of 1,2-dichlorobenzene and 0.2 g of styrene are weighed accurately in a 20-mL screw tube for diluting with 10 g of acetone, and then mixed well.
3. 0.2 g of 1,2-dichlorobenzene and 0.3 g of styrene are weighed accurately in a 20-mL screw tube and diluted with 10 g of acetone, and then mixed well.
4. One micro-litter of each sample regulated in the above steps 1 to 3 is sorted in a 20-mL screw tube using a micro syringe and diluted with 10 g of acetone, and then mixed well.
5. Samples obtained in the step 4 are respectively injected into gas chromatograph under the above conditions.
6. An AREA value is obtained according to the concentrations of each sample respectively by the gas chromatograph.
7. With respect to the ratio ($x_1$) of AREA values of styrene to 1,2-dichlorobenzene, the weight ratio ($=y_1$) of styrene to 1,2-dichlorobenzene is plotted and a first-order approximate expression ($Y=ax+b$) is calculated using the least square method to prepare a calibration curve.

$R^2$ at this time is confirmed to be not less than 0.9800. When it is less than 0.9800, a calibration curve is prepared again.

The amount of styrene in a sample was calculated in the following manner.

1. The ratio of the AREA value of styrene to the AREA value of 1,2-dichlorobenzene in the sample obtained by gas chromatograph is defined as $x_2$.
2. By the substitution of $x_2$ for the first-order approximate expression of the calibration curve, the weight ratio ($=y_2$) of styrene to 1,2-dichlorobenzene is calculated.
3. The amount of styrene in the resin is calculated by the following equation.

$$\text{Amount of styrene(ppm)}=y_2\times z\times y_0/(1{,}000{,}000\times x_0)$$

The toner was also measured in the same manner.

<Amount of Component Having Molecular Weight of not Less than 400,000>

The mass ratio of the compound having a molecular weight of not less than 400,000 in the binder resin was calculated from the area ratio of the molecular weight distribution curve obtained by GPC measurement. Specifically, it was calculated by the following equation.

$$\text{Mass ratio(mass \%)of a component having a molecular weight of not less than 400,000}=\{(\text{Area integrated value of a molecular weight of not less than 400,000 and not more than 36,000,000})/(\text{Area integrated value of a molecular weight of not less than 100 and not more than 36,000,000})\}\times 100$$

Next, evaluation methods of the toner carried out in the present invention are described below.

1. Gloss

An unfixed image was formed using a copier produced by remodeling a commercial electrophotographic copier. Then, the unfixed image was fixed using a heat belt fixing apparatus produced by remodeling the fixing section of the commercial copier at a fixing speed of 125 mm/sec of the heat roller at a temperature of 150 degrees centigrade. The image density of the fixed image obtained at this time was measured using a Macbeth reflection densitometer and adjusted so as to be 1.4. The glossiness of the resulting fixed image was measured at an incident angle of 75° by means of a Variable Gloss Meter GM-3D (a product of Murakami Color Research Laboratory Co., Ltd.). Further, the atmosphere of the above copier was a temperature of 22 degrees centigrade and a relative humidity of 55%.

(Evaluation Standard)
A: 30%≦(not less than) Glossiness
B: 25%≦(not less than) Glossiness<(less than) 30%
C: Glossiness<(less than) 25%

2. Evaluation of Fixing Properties

Copy was performed at a copy speed of 72 sheets/min with the temperature of the fixing roll being changed in units of 5 degrees centigrade. A sand eraser ("MONO", a plastic sand eraser, manufactured by Tombow Pencil Co., Ltd.) was run back and forth ten times between a solid black portion and a white paper with a force of 1 kgf. Blackness of the solid black portion was measured by using an ink densitometer. The residual ratio of the toner was represented by the concentration ratio. The toner was evaluated at the lowest temperature when not less than 60% of the toner remained.

AA: not higher than 140 degrees centigrade
A: higher than 140 and not higher than 150 degrees centigrade
B: higher than 150 and not higher than 160 degrees centigrade
C: higher than 160 degrees centigrade 3. Evaluation of Offset The temperature at which high offset occurs while copying was evaluated.

AA: not lower than 230 degrees centigrade
A: not lower than 220 and lower than 230 degrees centigrade
B: not lower than 210 and lower than 220 degrees centigrade
C: lower than 210 degrees centigrade 4. Evaluation of Grindability In the production of a toner, the mixture kneaded using a twin screw kneader and cooled was partially collected and arranged at 10 mesh under and 16 mesh on particle size, and then ground using a jet mill.

The particle size distribution was measured using a coulter counter to determine the ratio of the particle size of 5 to 20μ.

AA: not less than 85%
A: not less than 70% and less than 85%
B: not less than 50% and less than 70%
C: less than 50%

5. Evaluation of Development Durability

The reproducibility of a toner was checked by conducting continuous copying of 10,000 copies by using a commercial high-speed copier (copy speed of 72 sheets/min) using the toner thus obtained, and then by copying a base paper with lines having a line width of 100 micro-meters. The above base paper was observed by using a microscope, and the line width on the paper was measured by 5-point examination in advance. The copied paper after copying and fixing the paper was also measured in the same manner with the line width by 5-point examination. The average of the line width of the base paper and that of the copied paper were obtained respectively, and the evaluation was made as follows, depending on the increase of the line width δ represented by the following equation.

Increase of the line width δ=Line width of the copied paper−Line width of the base paper A: δ<(less than) 5 micro-meters B: 5≦(not less than) δ<(less than) 10 micro-meters C: δ≦(not less than) 10 micro-meters

Production Examples of Glycidyl Group-Containing Vinyl Resin (E)

Production Example E-1

50 parts of xylene was fed into a flask purged with nitrogen and the resulting material was heated. Under xylene reflux, 78 parts of styrene, 20.5 parts of n-butyl acrylate, 1.5 parts of glycidyl methacrylate and 0.5 parts of di-t-butylperoxide previously mixed and dissolved were continuously added over 5 hours, and further continuously refluxed for 1 hour. Thereafter, while an internal temperature was maintained at 130 degrees centigrade, 0.5 mass parts of di-t-butylperoxide was added and the reaction was continued for 1 hour. Further, 0.5 mass parts of di-t-butylperoxide was added and the reaction was continued for 2 hours, whereby the reaction was completed to obtain a polymerization solution. The resulting polymerization solution was flashed in vessel of 10 mmHg at 200 degrees centigrade for removing a solvent or the like. The physical properties of the resulting vinyl resin are shown in Table 1.

Production Examples E-2 to E-5

Glycidyl-containing vinyl resins E-2 to E-5 were obtained in the same manner as in Production Example E-1 with feeding amounts as indicated in Table 1. The physical properties thereof are shown in Table 1.

Production Example E-6

In accordance with Production Example A-1 of Japanese Patent Laid-open No. 2002-189316, a glycidyl group-containing vinyl resin E-6 was obtained, specifically, in the following manner. 75 parts of xylene was fed into a flask purged with nitrogen and the resulting material was heated. Under xylene reflux, 65 parts of styrene, 30 parts of n-butyl acrylate, 5 parts of glycidyl methacrylate and 1 part of di-t-butylperoxide were continuously added over 5 hours, and further continuously refluxed for 1 hour. Thereafter, the residual monomer was polymerized twice for 2 hours to obtain a polymerization solution. Thereafter, a solvent or the like was removed. As for the physical properties of the resulting glycidyl group-containing vinyl resin E-6, the epoxy value was 0.039 Eq/100 g and the weight-average molecular weight Mw was 30,000.

Production Example E-7

In accordance with Production Example A of Japanese Patent Laid-open No. H10 (1998)-90943, a glycidyl group-containing vinyl resin E-7 was obtained, specifically, in the following manner. 75 parts of xylene was fed into a flask purged with nitrogen and the resulting material was heated. Under xylene reflux, 55 parts of styrene, 40 parts of n-butyl acrylate, 5 parts of glycidyl methacrylate and 2 parts of di-t-butylperoxide were continuously added over 5 hours, and further refluxed for 1 hour. Thereafter, the residual monomer was polymerized twice for 2 hours to obtain a polymerization solution. Thereafter, a solvent or the like was removed, and the resulting material was cooled and ground. The weight-average molecular weight of the resulting glycidyl group-containing vinyl resin E-7 was 19,000 while its epoxy value was 0.035 Eq/100 g.

TABLE 1

| | | Production Examples | | | | | | |
|---|---|---|---|---|---|---|---|---|
| | Unit | E-1 | E-2 | E-3 | E-4 | E-5 | E-6 | E-7 |
| styrene | parts | 78 | 81.5 | 75 | 76 | 76 | 65 | 55 |
| n-butyl acrylate | parts | 20.5 | 18.5 | 23.5 | 21.5 | 15 | 30 | 40 |
| glycidyl methacrylate | parts | 1.5 | 1.5 | 1.5 | 0.65 | 13 | 5 | 5 |
| di-t-butyl peroxide (first) | parts | 0.5 | 1.5 | 0.25 | 0.5 | 0.5 | 1 | 2 |
| di-t-butyl peroxide (second) | parts | 0.5 | 0.5 | 0.5 | 0.5 | 0.5 | | |
| di-t-butyl peroxide (third) | parts | 0.5 | 0.5 | 0.5 | 0.5 | 0.5 | | |
| xylene | parts | 50 | 50 | 40 | 50 | 50 | 75 | 75 |
| Epoxy value | Eq/100 g | 0.012 | 0.012 | 0.012 | 0.005 | 0.095 | 0.039 | 0.035 |
| Peak molecular weight | | 45,000 | 25,000 | 70,000 | 45,000 | 45,000 | 30,000 (polymerization average molecular weight) | 19,000 (polymerization average molecular weight) |

Production Examples of Low Molecular Weight Vinyl Resin (L)

Production Example L-1

75 parts of xylene was fed into a flask purged with nitrogen and the resulting material was heated. Under xylene reflux, 80.5 parts of styrene, 18.5 parts of n-butyl acrylate, 1.0 part of methacrylic acid and 2.5 parts of t-butylperoxy-2-ethylhexanoate previously mixed and dissolved were continuously added over 5 hours, and further continuously refluxed for 1 hour. Thereafter, while an internal temperature was maintained at 98 degrees centigrade, 0.5 mass parts of t-butylperoxy-2-ethylhexanoate was added and the reaction was continued for 1 hour. Further, 0.5 mass parts of t-butylperoxy-2-ethylhexanoate was added and the reaction was continued for 2 hours, whereby the reaction was completed to obtain a polymerization solution L-1. The physical properties of the resulting vinyl resin are shown in Table 2.

Production Examples L-2 to L-9

Low molecular weight vinyl resins L-2 to L-9 were obtained in the same manner as in Production Example L-1 with feeding amounts as indicated in Table 2. The physical properties thereof are shown in Table 2.

Production Examples of High Molecular Weight Vinyl Resin (H)

Production Example H-1

As vinyl monomers, 74.0 parts of styrene, 23.5 parts of n-butyl acrylate and 2.5 parts of methacrylic acid were fed into a flask purged with nitrogen. The resulting material was heated to an internal temperature of 120 degrees centigrade and then kept at the same temperature for carrying out bulk polymerization for 10 hours. Subsequently, 50 parts of xylene and 0.2 parts of tetraethylene diacrylate were added thereto, and 0.1 part of dibutyl peroxide and 60 parts of xylene previously mixed and dissolved were continuously added over 8 hours while maintaining at a temperature of 130 degrees centigrade. Furthermore, 0.2 mass % of 1,1-bis(t-butylperoxy)-3,3,5-trimethylcyclohexane was added thereto and the reaction was continued for 2 hours. Thereafter, 0.5 mass % of 1,1-bis(t-butylperoxy)-3,3,5-trimethylcyclohexane was further added and the mixture was kept for 2 hours, whereby the reaction was completed to obtain a high molecular weight polymerization solution H-1. The physical properties of the resulting vinyl resin are shown in Table 3.

TABLE 2

| | | Production Examples | | | | | | | | |
|---|---|---|---|---|---|---|---|---|---|---|
| | Unit | L-1 | L-2 | L-3 | L-4 | L-5 | L-6 | L-7 | L-8 | L-9 |
| xylene | parts | 75 | 75 | 75 | 75 | 75 | 75 | 75 | 75 | 75 |
| styrene | parts | 80.5 | 81.3 | 76.5 | 83 | 79 | 81.5 | 73.5 | 84 | 80 |
| n-butyl acrylate | parts | 18.5 | 18.5 | 18.5 | 16 | 20 | 18.5 | 18.5 | 15 | 19 |
| methacrylic acid | parts | 1 | 0.2 | 5 | 1 | 1 | 0 | 7.5 | 1 | 1 |
| t-butyl peroxy-2-ethylhexanoate (first) | parts | 2.5 | 2.5 | 2.5 | 3 | 2.3 | 2.5 | 2.5 | 5 | 2 |
| t-butyl peroxy-2-ethylhexanoate (second) | parts | 0.5 | 0.5 | 0.5 | 0.5 | 0.5 | 0.5 | 0.5 | 0.5 | 0.5 |
| t-butyl peroxy-2-ethylhexanoate (third) | parts | 0.5 | 0.5 | 0.5 | 0.5 | 0.5 | 0.5 | 0.5 | 0.5 | 0.5 |
| Peak molecular Weight | | 13500 | 13500 | 13500 | 11000 | 14500 | 13500 | 13500 | 8000 | 18000 |
| Acid value | KOHmg/g | 6.5 | 1.3 | 32.5 | 6.5 | 6.5 | 0 | 48.75 | 6.5 | 6.5 |

Production Examples H-2 to H-6

High molecular weight vinyl resins H-2 to H-6 were obtained in the same manner as in Production Example H-1 with feeding amounts as indicated in Table 3. The physical properties thereof are shown in Table 3.

TABLE 3

| | | Production Examples | | | | | |
|---|---|---|---|---|---|---|---|
| | Unit | H-1 | H-2 | H-3 | H-4 | H-5 | H-6 |
| styrene | parts | 74 | 75 | 73.5 | 74 | 76.5 | 71.9 |
| n-butyl acrylate | parts | 23.5 | 23.5 | 23.5 | 23.5 | 23.5 | 23.5 |
| methacrylic acid | parts | 2.5 | 1.5 | 3 | 2.5 | 0 | 4.6 |
| Bulk polymerization Temperature | ° C. | 120 | 120 | 120 | 120 | 120 | 120 |
| xylene | parts | 50 | 50 | 50 | 50 | 50 | 50 |
| tetraethylene diacrylate | parts | 0.2 | 0.2 | 0.2 | 0 | 0.2 | 0.2 |
| Peak molecular weight | | 300,000 | 300,000 | 300,000 | 200,000 | 300,000 | 300,000 |
| Acid value | KOHmg/g | 16.25 | 9.75 | 19.5 | 16.25 | 0 | 29.9 |

Production Examples of Carboxyl Group-containing Vinyl Resin (C)

Production Examples C-1 to C-12

Respective polymerization solutions were mixed such that the mass ratio of a high molecular weight vinyl resin (H) to a low molecular weight vinyl resin (L) was the ratio as described in Table 4. Then, the mixture was flashed in a vessel at 1.33 kPa and 200 degrees centigrade for removing a solvent or the like to obtain resins C-1 to C-12. The physical properties of the resulting vinyl resins are shown in Tables 4-1 and 4-2.

Production Example C-13

In accordance with Production Example B-1 of Japanese Patent Laid-open No. 2002-189316, a resin C-13 was obtained, specifically, in the following manner.

Firstly, 0.6 parts of di-t-butylperoxide per 100 parts of styrene was homogeneously dissolved in a solution consisting of 57.4 parts of styrene, 11.9 parts of n-butyl acrylate, 0.7 parts of methacrylic acid and 30 parts of xylene solvent to obtain a homogeneous solution. The obtained homogenous solution was continuously fed into a 5-L reactor maintained at 190 degrees centigrade of the internal temperature and 0.59 MPa of the internal pressure at a rate of 750 cc/hr. The resulting mixture was polymerized to obtain a low molecular weight polymerization solution.

Separately, as vinyl monomers, 75 parts of styrene, 23.5 parts of n-butyl acrylate and 1.5 parts of methacrylic acid were fed into a flask purged with nitrogen. The internal temperature was raised to 120 degrees centigrade, and bulk polymerization was performed for 10 hours. Subsequently, 50 parts of xylene was added, 0.1 part of dibutyl peroxide and 50 parts of xylene were continuously added thereto over 8 hours while maintaining the temperature at 130 degrees centigrade. The residual monomer was further polymerized for 2 hours to obtain a high molecular weight polymerization solution. As for the physical properties of the resulting vinyl resin, the acid value was 7.3 mgKOH/g and Tg was 58 degrees centigrade.

Lastly, 100 parts of the aforementioned low molecular weight polymerization solution and 60 parts of the high molecular weight polymerization solution were mixed. Thereafter, a solvent or the like was removed.

Production Example C-14

In accordance with Production Example B-2 of Japanese Patent Laid-open No. 2002-189316, a resin C-14 was obtained, specifically, in the following manner. The carboxyl group-containing vinyl resin C-14 was obtained in the same manner as in Production Example C-16, except that 57.4 parts of styrene was changed to 54.6 parts and 0.7 parts of methacrylic acid was changed to 3.5 parts in the preparation of the low molecular weight polymerization solution in Production Example C-13.

Production Example C-15

In accordance with Production Example A of Japanese Patent Laid-open No. H10 (1998)-90943, a resin C-15 was obtained, specifically, in the following manner. 0.6 parts of di-t-butylperoxide per 100 parts of vinyl monomer was homogeneously dissolved in a solution consisting of 56.0 parts of styrene, 11.9 parts of n-butyl acrylate, 2.1 parts of methacrylic acid and 30 parts of xylene solvent as vinyl monomers to obtain a homogeneous solution. The obtained homogenous solution was polymerized to obtain a vinyl resin polymerization solution. Thereafter, a solvent or the like was removed, and the resulting material was cooled and ground. The peak molecular weight of the resulting carboxyl group-containing vinyl resin C-15 was 18,000, Tg was 59 degrees centigrade, and the acid value was 19 mgKOH/g.

Production Example C-16

A resin C-16 was obtained in the same manner as in Production Example C-1, except that the polymerization solution was mixed such that the mass ratio of the high molecular weight vinyl resin H-1 to the low molecular weight vinyl resin L-1 was 40:60. The physical properties of the resulting resin are shown in Tables 4-1 and 4-2.

Production Example C-17

A resin C-17 was obtained in the same manner as in Production Example C-1, except that 2 parts of paraffin wax, HNP-9 (a product of Nippon Seiro Co., Ltd.), was further added.

TABLE 4-1

| | Unit | Production Examples | | | | | | |
|---|---|---|---|---|---|---|---|---|
| | | C-1 | C-2 | C-3 | C-4 | C-5 | C-6 | C-7 |
| High molecular weight vinyl resin (H) | | H1 | H2 | H3 | H4 | H1 | H1 | H1 |
| Low molecular weight vinyl resin (L) | | L1 | L2 | L3 | L1 | L4 | L5 | L1 |
| Ratio of high molecular weight vinyl resin (H) | parts | 20 | 20 | 20 | 20 | 20 | 20 | 10 |
| Ratio of low molecular weight vinyl resin (L) | parts | 80 | 80 | 80 | 80 | 80 | 80 | 90 |
| Acid value | KOHmg/g | 8.5 | 3.0 | 30 | 8.5 | 8.5 | 8.5 | 7.5 |

TABLE 4-2

| | Unit | Production Examples | | | | | |
|---|---|---|---|---|---|---|---|
| | | C-8 | C-9 | C-10 | C-11 | C-12 | C-16 |
| High molecular weight vinyl resin (H) | | H1 | H5 | H1 | H1 | H1 | H1 |
| Low molecular weight vinyl resin (L) | | L1 | L6 | L8 | L9 | L1 | L1 |
| Ratio of high molecular weight vinyl resin (H) | parts | 30 | 20 | 20 | 20 | 50 | 40 |
| Ratio of low molecular weight vinyl resin (L) | parts | 70 | 80 | 80 | 80 | 50 | 60 |
| Acid value | KOHmg/g | 9.4 | 0.0 | 8.5 | 8.5 | 11.4 | 10.4 |

Production Examples of Binder Resin for Color Toners (R)

Production Examples R-1 to R-17 and R-21 to R-22

Respective resins were mixed such that the mass ratio of the carboxyl group-containing vinyl resin (C) to the glycidyl group-containing vinyl resin (E) was the ratio as described in Table 6. Then, the mixture was reacted by the use of a twin screw kneader (KEXN S-40 type, a product of Kurimoto Ltd.) with its temperature set to the temperature as described in Tables 5 and 6. In the middle of the reaction, water was injected once at 2.0 MPa. The contact time of the resin and water was 1.5 seconds. Furthermore, a pressure reducing port installed at an outlet side from a water inlet of the aforementioned water was equipped with a pressure reducing pump and the volatile component was removed by reducing the pressure down to 0.095 MPa based on an absolute pressure. After 90 seconds of the residence time, the resulting material was cooled and ground to obtain binder resins R-1 to R-24. As a method for cooling, a steel belt cooler (NR3-Hi double cooler, a product of Nippon Belting Co., Ltd.) was used under conditions of the cooling water temperature of 10 degrees centigrade, the amount of cooling water of 90 L/min and a belt speed of 6 m/min. The physical properties are shown in Tables 5 and 6.

Production Examples of Electrophotographic Toner (T)

Production Examples T-1 to T-17, and T-21 to T-22

6 mass parts of carbon black (MA100, a product of Mitsubishi Kasei Kogyo K.K.), 2.5 mass parts of polypropylene wax (Hi-wax NP105, a product of Mitsui Chemicals, Inc.) and 0.5 mass parts of a charge controlling agent (T-77, a product of Hodogaya Chemical Co., Ltd.) were added to 100 mass parts of the binder resin (R) described in Table 6. The resulting mixture was mixed by means of a Henschel mixer, and then kneaded in a twin screw kneader (PCM-30 type, a product of Ikegai Corporation) at 120 degrees centigrade of the resin temperature at the discharge portion of the twin screw kneader for 30 seconds of the residence time. Next, after cooling, grinding and classifying, color toners T-1 to T-17 and T-21 to T-22 having a volume median diameter D50 measured with a coulter counter of about 8 micro-meters were obtained.

Examples 1 to 15 and Comparative Examples 1 to 4

3 mass parts of the color toner T-1 was mixed into 97 mass parts of a carrier (F-150, a product of Powdertech Corp.), to give a developing agent, with which an image was drawn by using a copier produced by remodeling a commercial high-speed copier for evaluation. With respect to other toners (T-2 to T-17 and T-21 to T-22), developing agents were prepared and evaluated in the same manner. The results thus evaluated are shown in Tables 5-1 and 5-2 and 6.

Incidentally, the resin R-22 in Example 15 contains paraffin wax as described in the above Production Example C-17. As described above, in the present specification, the THF insoluble portion is defined as the THF insoluble gel portion. Accordingly, the THF insoluble portion in Example 15 refers to the THF insoluble portion of the resin R-22 without containing paraffin wax.

TABLE 5-1

| | Unit | Examples | | | | | | | |
|---|---|---|---|---|---|---|---|---|---|
| | | Example 1 | Example 2 | Example 3 | Example 4 | Example 5 | Example 6 | Example 7 | Example 8 |
| Toner (T) | | T-1 | T-2 | T-3 | T-4 | T-5 | T-6 | T-7 | T-8 |
| Binder resin (R) | | R-1 | R-2 | R-3 | R-4 | R-5 | R-6 | R-7 | R-8 |
| Carboxyl group-containing vinyl resin (C) | | C-1 | C-2 | C-3 | C-1 | C-1 | C-1 | C-1 | C-4 |
| Glycidyl group-containing vinyl resin (E) | | E-1 | E-1 | E-1 | E-2 | E-3 | E-4 | E-5 | E-1 |
| Carboxyl group-containing vinyl resin (C) | parts | 93 | 93 | 93 | 93 | 93 | 93 | 93 | 93 |
| Glycidyl group-containing vinyl resin (E) | parts | 7 | 7 | 7 | 7 | 7 | 7 | 7 | 7 |
| Melt-kneading temperature | ° C. | 170 | 170 | 170 | 170 | 170 | 170 | 170 | 170 |
| Residence time | sec. | 90 | 90 | 90 | 90 | 90 | 90 | 90 | 90 |
| Water addition | | Yes | Yes | Yes | Yes | Yes | Yes | Yes | Yes |
| Residual volatile content | ppm | 80 | 80 | 80 | 80 | 80 | 80 | 80 | 80 |
| Main peak molecular weight | | 13500 | 13500 | 13500 | 13500 | 13500 | 13500 | 13500 | 13500 |
| Mw/Mn | | 26 | 25 | 23 | 27 | 24 | 28 | 25 | 24 |
| Area ratio (%) of molecular weight of not less than 400000 | % | 6.1 | 7.5 | 3.1 | 6.9 | 5.2 | 8.2 | 3.9 | 5.7 |
| THF insoluble portion | % | 0.5 | 0.2 | 0.7 | 0.4 | 0.7 | 0.2 | 0.8 | 0.4 |
| Storage modulus G' at 160° C. | Pa | 163 | 155 | 196 | 130 | 212 | 82 | 245 | 106 |
| Softening point | ° C. | 118 | 116 | 120 | 117 | 120 | 117 | 120 | 111 |
| [Toner evaluation items] | | | | | | | | | |
| Gloss | | A | A | B | A | B | A | B | A |
| Fixing property evaluation | | AA | AA | A | AA | A | AA | A | AA |
| Offset evaluation | | AA | A | AA | A | AA | A | AA | A |
| Grindability evaluation | | AA | AA | AA | AA | A | AA | AA | AA |
| Development durability evaluation | | A | A | A | A | A | A | A | A |
| Storage modulus G' at 160° C. | Pa | 478 | 472 | 522 | 460 | 532 | 411 | 573 | 443 |

TABLE 5-2

| | Unit | Examples | | | | | | |
|---|---|---|---|---|---|---|---|---|
| | | Example 9 | Example 10 | Example 11 | Example 12 | Example 13 | Example 14 | Example 15 |
| Toner (T) | | T-9 | T-10 | T-11 | T-12 | T-13 | T-21 | T-22 |
| Binder resin (R) | | R-9 | R-10 | R-11 | R-12 | R-13 | R-21 | R-22 |
| Carboxyl group-containing vinyl resin (C) | | C-5 | C-6 | C-7 | C-8 | C-1 | C-16 | C-17 |
| Glycidyl group-containing vinyl resin (E) | | E-1 | E-1 | E-1 | E-1 | E-1 | E-1 | E-1 |
| Carboxyl group-containing vinyl resin (C) | parts | 93 | 93 | 93 | 93 | 93 | 93 | 93 |
| Glycidyl group-containing vinyl resin (E) | parts | 7 | 7 | 7 | 7 | 7 | 7 | 7 |
| Melt-kneading temperature | ° C. | 170 | 170 | 170 | 170 | 220 | 170 | 170 |
| Residence time | sec. | 90 | 90 | 90 | 90 | 60 | 90 | 90 |
| Water addition | | Yes | Yes | Yes | Yes | Yes | Yes | Yes |
| Residual volatile content | ppm | 80 | 80 | 80 | 80 | 180 | 80 | 80 |
| Main peak molecular weight | | 11000 | 14500 | 13500 | 13500 | 13500 | 13500 | 13500 |
| Mw/Mn | | 25 | 26 | 9 | 41 | 20 | 26 | 27 |
| Area ratio (%) of molecular weight of not less than 400000 | % | 7.6 | 7.3 | 2.4 | 9.8 | 3.5 | 16.6 | 5.8 |
| THF insoluble portion | % | 0.5 | 0.5 | 0.3 | 0.8 | 0.9 | 0.8 | 0.6 |
| Storage modulus G' at 160° C. | Pa | 122 | 204 | 82 | 1060 | 228 | 1352 | 153 |
| Softening point | ° C. | 116 | 119 | 110 | 127 | 122 | 129 | 117 |
| [Toner evaluation items] | | | | | | | | |
| Gloss | | A | A | A | B | B | B | A |
| Fixing property evaluation | | AA | AA | AA | A | A | B | AA |
| Offset evaluation | | A | AA | A | AA | AA | AA | AA |
| Grindability evaluation | | AA | AA | AA | A | AA | B | AA |
| Development durability evaluation | | A | A | A | A | A | A | A |
| Storage modulus G' at 160° C. | Pa | 458 | 538 | 396 | 1322 | 587 | 1522 | 442 |

Comparative Examples 5 to 7

Toners were prepared as described below and evaluated.

Firstly, binder resins for toners R-18 to R-20 were respectively prepared in the same manner as in the above Production Examples R-1 to R-17 and T-21 to T-22. Subsequently, toners T-18 to T-20 were prepared in the same manner as in the above Examples and Comparative Examples. Developing agents were prepared and evaluated in the same manner as in the above Examples and Comparative Examples. The results are shown in Table 6.

TABLE 6

| | Unit | Comparative Examples | | | | | | |
|---|---|---|---|---|---|---|---|---|
| | | Comparative Example 1 | Comparative Example 2 | Comparative Example 3 | Comparative Example 4 | Comparative Example 5 | Comparative Example 6 | Comparative Example 7 |
| Toner (T) | | T-14 | T-15 | T-16 | T-17 | T-18 | T-19 | T-20 |
| Binder resin (R) | | R-14 | R-15 | R-16 | R-17 | R-18 | R-19 | R-20 |
| Carboxyl group-containing vinyl resin (C) | | C-9 | C-10 | C-11 | C-12 | C-13 | C-14 | C-15 |
| Glycidyl group-containing vinyl resin (E) | | E-1 | E-1 | E-1 | E-1 | E-6 | E-6 | E-7 |
| Carboxyl group-containing vinyl resin (C) | parts | 93 | 93 | 93 | 93 | 93 | 97 | 90 |
| Glycidyl group-containing vinyl resin (E) | parts | 7 | 7 | 7 | 7 | 7 | 3 | 10 |
| Melt-kneading temperature | ° C. | 170 | 170 | 170 | 170 | 185 | 185 | 170 |
| Residence time | sec. | 90 | 90 | 90 | 90 | 90 | 90 | 90 |
| Water addition | | Yes | Yes | Yes | Yes | Yes | Yes | Yes |
| Residual volatile content | ppm | 80 | 80 | 80 | 80 | 80 | 80 | 80 |
| Main peak molecular weight | | 13500 | 8000 | 18000 | 13500 | 12000 | 12000 | 18000 |
| Mw/Mn | | 31 | 23 | 27 | 51 | 15 | 17 | 18 |
| Area ratio (%) of molecular weight of not less than 400000 | % | 8.8 | 6.1 | 6.1 | 21.5 | 11.0 | 10.3 | 3.0 |
| THF insoluble portion | % | 0 | 0.5 | 0.5 | 0.9 | 15 | 3 | 4 |
| Storage modulus G' at 160° C. | Pa | 33 | 81 | 253 | 1823 | 4521 | 1226 | 2351 |
| Softening point | ° C. | 114 | 114 | 121 | 136 | 140 | 131 | 134 |
| [Toner evaluation items] | | | | | | | | |
| Gloss | | A | A | A | C | C | C | C |
| Fixing property evaluation | | AA | AA | C | C | A | AA | A |
| Offset evaluation | | C | C | AA | AA | AA | A | A |
| Grindability evaluation | | AA | AA | B | C | A | A | A |
| Development durability evaluation | | B | C | A | A | A | A | A |
| Storage modulus G' at 160° C. | Pa | 330 | 418 | 578 | 1963 | 4725 | 1398 | 1532 |

As described above, toners excellent in balancing various properties required for a toner were obtained in Examples. Besides, color toners excellent in the gloss and suitable for use in color toners were obtained. In these Examples and Comparative Examples, black toners were prepared. When black toners were used as color toners, the gloss was also required for black toners. Accordingly, sufficient gloss was not achieved for black toners for monochrome use. In competitive example 1 to 4, color toner inferior in balancing various properties were obtained. Furthermore, in Comparative Examples 5 to 7, the THF insoluble portion was in large quantities, whereby the gloss performance required for color toners could not be achieved.

The invention claimed is:

1. A binder resin for color toners, wherein the binder resin comprises at least a carboxyl group-containing vinyl resin (C), a glycidyl group-containing vinyl resin (E) and a reaction product thereof, and comprises both a tetrahydrofuran (THF) soluble portion and a THF insoluble gel portion, said THF soluble portion has a main peak in the molecular weight region of not less than 10,000 and less than 15,000 in the chromatogram obtained by gel permeation chromatography (GPC), the content of said THF insoluble gel portion is less than 1 mass %, the softening point is not more than 130 degrees centigrade, the weight-average molecular weight (Mw)/the number-average molecular weight (Mn) is not less than 8, and wherein the storage modulus G' at 160 degrees centigrade is not less than 50 and less than 1,500 Pa measured at a frequency of 6.28 rad/sec.

2. The binder resin for color toners as set forth in claim 1, wherein the content of a volatile component remained in said binder resin is not more than 200 ppm.

3. The binder resin for color toners as set forth in claim 1, satisfying the following conditions: said carboxyl group-containing vinyl resin (C) contains a high molecular weight vinyl resin (H) in which the THF soluble portion has a peak in the molecular weight region of not less than 150,000 and less than 600,000 in the GPC chromatogram and a low molecular weight vinyl resin (L) in which the THF soluble portion has a peak in the molecular weight region of not less than 10,000 and less than 15,000 in the GPC chromatogram;

the mass ratio (H/L) of said high molecular weight vinyl resin (H) to said low molecular weight vinyl resin (L) in said carboxyl group-containing vinyl resin (C) is from 5/95 to 40/60;

the acid value of said carboxyl group-containing vinyl resin (C) is not less than 1 mgKOH/g and not more than 35 mgKOH/g; and the THF soluble portion in said glycidyl group-containing vinyl resin (E) has a peak in the molecular weight region of not less than 20,000 and not more than 80,000 in the GPC chromatogram and the epoxy value of said glycidyl group-containing vinyl resin (E) is from 0.003 to 0.1 Eq/100 g.

4. The binder resin for color toners as set forth in claim 1, wherein the weight-average molecular weight (Mw)/the number-average molecular weight (Mn) is not less than 9 and not more than 41.

5. The binder resin for color toners as set forth in claim 1, wherein the binder resin does not substantially have a peak in the molecular weight region of not less than 400,000 in the GPC chromatogram.

6. The binder resin for color toners as set forth in claim 1, wherein the binder resin has a second peak in the molecular weight region of not less than 200,000 and less than 300,000 in the GPC chromatogram.

7. The binder resin for color toners as set forth in claim 1, wherein a component having a molecular weight of not less than 400,000 is not more than 18 mass %.

8. A method for producing the binder resin for color toners as set forth in claim 1, comprising a step of melt-kneading at least one of the carboxyl group-containing vinyl resins (C) and at least one of the glycidyl group-containing vinyl resins (E) at a temperature range of not lower than 140 degrees centigrade and not higher than 220 degrees centigrade, and reacting a carboxyl group with a glycidyl group.

9. A color toner comprising at least the binder resin for color toners as set forth in claim 1, a coloring agent and a charge controlling agent.

10. The color toner as set forth in claim 9, wherein said color toner is obtained by a grinding method.

11. The binder resin for toners as set forth in claim 1, wherein a component having a molecular weight of not less than 400,000 is not more than 10 mass %.

12. A binder resin for color toners, wherein the binder resin comprises at least a carboxyl group-containing vinyl resin (C), a glycidyl group-containing vinyl resin (E) and a reaction product thereof, and comprises both a tetrahydrofuran (THF) soluble portion and a THF insoluble gel portion, said THF soluble portion has a main peak in the molecular weight region of not less than 10,000 and less than 15,000 in the chromatogram obtained by gel permeation chromatography (GPC), the content of said THF insoluble gel portion is less than 1 mass %, the softening point is not more than 130 degrees centigrade, the weight-average molecular weight (Mw)/the number-average molecular weight (Mn) is not less than 9 and not more than 41, the binder resin does not substantially have a peak in the molecular weight region of not less than 400,000 in the GPC, and wherein the storage modulus G' at 160 degrees centigrade is not less than 50 and less than 1,500 Pa measured at a frequency of 6.28 rad/sec.

13. The binder resin for color toners as set forth in claim 12, wherein the content of a volatile component remained in said binder resin is not more than 200 ppm.

14. The binder resin for color toners as set forth in claim 12, satisfying the following conditions: said carboxyl group-containing vinyl resin (C) contains a high molecular weight vinyl resin (H) in which the THF soluble portion has a peak in the molecular weight region of not less than 150,000 and less than 600,000 in the GPC chromatogram and a low molecular weight vinyl resin (L) in which the THF soluble portion has a peak in the molecular weight region of not less than 10,000 and less than 15,000 in the GPC chromatogram;

the mass ratio (H/L) of said high molecular weight vinyl resin (H) to said low molecular weight vinyl resin (L) in said carboxyl group-containing vinyl resin (C) is from 5/95 to 40/60;

the acid value of said carboxyl group-containing vinyl resin (C) is not less than 1 mgKOH/g and not more than 35 mgKOH/g; and the THF soluble portion of said glycidyl group-containing vinyl resin (E) has a peak in the molecular weight region of not less than 20,000 and not more than 80,000 in the GPC chromatogram and the epoxy value of said glycidyl group-containing vinyl resin (E) is from 0.003 to 0.1 Eq/100 g.

15. The binder resin for color toners as set forth in claim 12, wherein the binder resin has a second peak in the molecular weight region of not less than 200,000 and less than 300,000 in the GPC chromatogram.

16. The binder resin for color toners as set forth in claim 12, wherein a component of a molecular weight of not less than 400,000 is not more than 18 mass %.

17. A method for producing the binder resin for color toners as set forth in claim 12, comprising a step of melt-kneading at least one of the carboxyl group-containing vinyl resins (C) and at least one of the glycidyl group-containing vinyl resins (E) at a temperature range of not lower than 140 degrees centigrade and not higher than 220 degrees centigrade, and reacting a carboxyl group with a glycidyl group.

18. A color toner comprising at least the binder resin for color toners as set forth in claim 12, a coloring agent and a charge controlling agent.

19. The color toner as set forth in claim 18, wherein said color toner is obtained by a grinding method.

20. The binder resin for color toners as set forth in claim 12, wherein a component of a molecular weight of not less than 400,000 is not more than 10 mass %.

* * * * *